US010876735B2

(12) United States Patent
Ivanovic et al.

(10) Patent No.: US 10,876,735 B2
(45) Date of Patent: Dec. 29, 2020

(54) LOCKING DEVICE FOR A DOOR OF A DOMESTIC APPLIANCE

(71) Applicant: ELECTROLUX APPLIANCES AKTIEBOLAG, Stockholm (SE)

(72) Inventors: Branko Ivanovic, Rothenburg ob der Tauber (DE); Rudolf Schmidt, Rothenburg ob der Tauber (DE); Dietmar Hildner, Rothenburg ob der Tauber (DE); Erhard Käser, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 317 days.

(21) Appl. No.: 15/563,073

(22) PCT Filed: Apr. 20, 2016

(86) PCT No.: PCT/EP2016/058701
§ 371 (c)(1),
(2) Date: Sep. 29, 2017

(87) PCT Pub. No.: WO2016/177574
PCT Pub. Date: Nov. 10, 2016

(65) Prior Publication Data

US 2018/0087778 A1 Mar. 29, 2018

(30) Foreign Application Priority Data

May 7, 2015 (EP) ..... 15166800

(51) Int. Cl.
*E05B 47/00* (2006.01)
*E05B 47/02* (2006.01)
(Continued)

(52) U.S. Cl.
CPC ..... *F24C 15/022* (2013.01); *E05B 47/0046* (2013.01); *E05B 47/023* (2013.01);
(Continued)

(58) Field of Classification Search
CPC ..... Y10S 292/69; Y10T 292/1082; Y10T 292/1028; Y10T 292/1043; Y10T 292/1056; Y10T 292/093; Y10T 292/0947
See application file for complete search history.

(56) References Cited

U.S. PATENT DOCUMENTS 671,899 A * 4/1901 Spence ..... E05B 55/005 292/169.14
2,898,138 A * 8/1959 Van Noord ..... E05B 47/0012 292/122
(Continued)

FOREIGN PATENT DOCUMENTS

DE 19848275 4/2000
DE 102004013297 A1 9/2005
(Continued)

OTHER PUBLICATIONS

International Search Report and Written Opinion for PCT/EP2016/058701, dated Jul. 4, 2016, 9 pages.
(Continued)

*Primary Examiner* — Carlos Lugo
(74) *Attorney, Agent, or Firm* — Pearne & Gordon LLP

(57) ABSTRACT

The present invention relates to a locking device (10) for a door of a domestic appliance. The locking device (10) comprises a main body (12) and a locking hook element (14) supported pivoting in and/or at the main body (12). The locking hook element (14) is pivoting between an engaged position and a disengaged position. The locking hook element (14) is engageable with and disengageable from a corresponding counterpart (40). The locking device (10)
(Continued)

Figure 1:
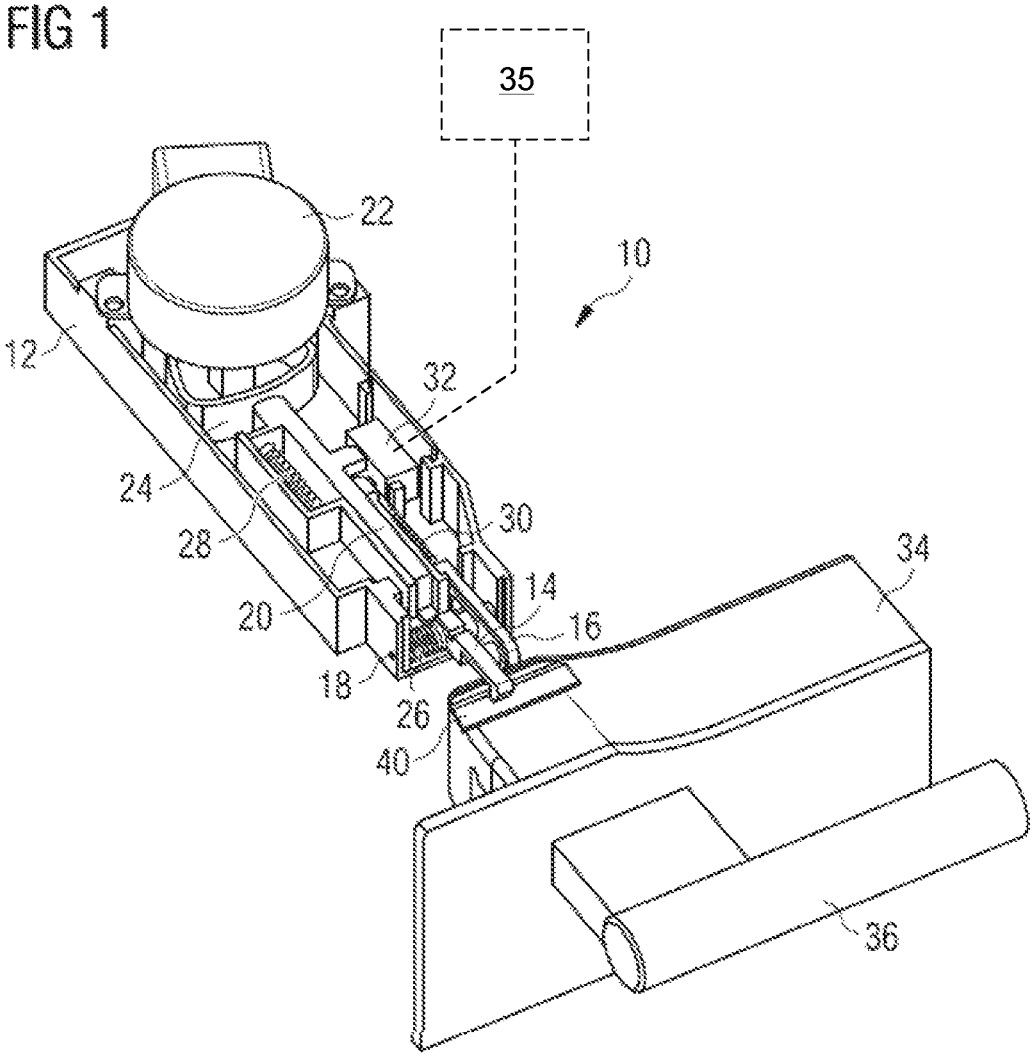

comprises an electric actuator (22) arranged in and/or at the main body (12) and mechanically connected or connectable to the locking hook element (14). The electric actuator (22) effects the pivoting of the locking hook element (14) from the engaged position to the disengaged position. The locking device (10) comprises a first spring element (26) interconnected between the locking hook element (14) and the main body (10), wherein said first spring element (26) effects a movement of the locking hook element (14) from the disengaged position to the engaged position.

19 Claims, 6 Drawing Sheets

(51) Int. Cl.
*F24C 15/02* (2006.01)
*F24C 14/02* (2006.01)

(52) U.S. Cl.
CPC ..... *F24C 14/02* (2013.01); *E05B 2047/0024* (2013.01); *E05B 2047/0068* (2013.01); *Y10S 292/69* (2013.01); *Y10T 292/1082* (2015.04)

(56) References Cited

U.S. PATENT DOCUMENTS

| | | | | |
|---|---|---|---|---|
| 2,934,059 | A | 4/1960 | Baker | |
| 2,983,000 | A * | 5/1961 | Metzger | E05B 65/0811 49/35 |
| 3,462,584 | A * | 8/1969 | Guy | F24C 14/02 219/412 |
| 3,503,380 | A | 3/1970 | Vasaturo | |
| 3,543,547 | A * | 12/1970 | Kazuo | E05B 47/0047 70/277 |
| 3,566,703 | A * | 3/1971 | Van Noord | B62D 1/181 74/50 |
| 4,088,354 | A * | 5/1978 | Kolendowicz | E05B 47/0603 292/201 |
| 4,703,960 | A * | 11/1987 | Lense | E05B 47/0012 292/192 |
| 5,613,716 | A * | 3/1997 | Cafferty | E05B 81/14 292/201 |
| 6,913,296 | B2 * | 7/2005 | Bassi | A47L 15/4259 292/122 |
| 7,036,853 | B2 * | 5/2006 | Smock | E05B 17/0029 292/109 |
| 7,137,387 | B2 * | 11/2006 | Edwards | F24C 15/022 126/190 |
| 7,481,469 | B2 * | 1/2009 | Harrer | F24C 15/022 292/201 |
| 7,726,294 | B2 * | 6/2010 | Collene | F24C 15/022 126/192 |
| 8,052,233 | B2 | 11/2011 | Netzer | |
| 8,109,543 | B2 * | 2/2012 | Chirumbolo | E05B 15/101 126/197 |
| 8,109,583 | B2 | 2/2012 | Bruestle | |
| 8,186,730 | B2 * | 5/2012 | Berghahn | E05B 81/14 292/201 |
| 8,807,670 | B2 | 8/2014 | Blum | |
| 8,905,494 | B2 | 12/2014 | Kilic | |
| 9,587,837 | B2 * | 3/2017 | Colucci | E05B 63/20 |
| 2003/0041852 | A1 | 3/2003 | Ramsey et al. | |
| 2004/0163684 | A1 | 8/2004 | Hapke | |
| 2006/0145485 | A1 | 7/2006 | Hapke | |
| 2012/0111366 | A1 | 5/2012 | Baldwin | |

FOREIGN PATENT DOCUMENTS

| | | |
|---|---|---|
| EP | 0632180 | 9/1996 |
| EP | 1703212 | 9/2006 |
| EP | 1961901 | 8/2008 |
| EP | 2058464 A1 | 5/2009 |
| EP | 2450510 | 5/2012 |
| EP | 2527577 | 11/2012 |
| FR | 2687718 | 8/1993 |
| GB | 2176834 | 1/1987 |
| WO | 2012012408 | 1/2012 |

OTHER PUBLICATIONS

Communication Article 94(3) EPC for application No. 15166800.1 dated Apr. 6, 2018, 7 pages.
Extended European Search Report in corresponding European Application No. 19168849.8 dated Jul. 25, 2019, 10 pages.
International Search Report issued in PCT/EP2015/055215, dated Jun. 15, 2015, 2 pages.

* cited by examiner

LOCKING DEVICE FOR A DOOR OF A DOMESTIC APPLIANCE

The present invention relates to a locking device for a door of a domestic appliance. In particular, the domestic appliance is a cooking oven. Further, the domestic appliance may be a dishwasher, a washing machine or a tumble dryer. Moreover, the present invention relates to a domestic appliance including at least one door pivoted at one or more door hinges.

The doors of domestic appliances are equipped with a locking device for reasons of safety. The locking device prevents an opening of the door during the operating cycle of the domestic appliance. For example, the locking device is used on cooking ovens equipped with a pyrolytic self-cleaning function, wherein the locking device prevents an opening of the oven door at very high temperatures. Further, the locking device is also used for preventing the door being opened by children during normal operation of the oven.

A conventional locking device comprises a main body, a movable locking member and an actuation system. The main body is usually fastened to a chassis of the domestic appliance. The locking member is designed to interact with a retention element of the door.

It is also known that in certain situations there is the need to release the door of the domestic appliance manually. For example, in the case of malfunctioning of the actuation system the door must be released manually. Further, in the case of malfunctioning of the control system for the locking device or in the case of a fault in the electrical or electronic system of the domestic appliance, the door should be released manually.

For example, as an actuation system a wax electro-thermal motor, a solenoid or a stepper motor may be used. The main purpose of this actuation system is to provide a force and push some sliding elements, which interacts with pawls or hooks, and moves said sliding elements into the locked or unlocked position. Furthermore, the above said slider needs a co-operated return spring to push it into the engaged position to the above mentioned motor.

However, the known actuation systems require a relative long reaction time. Their structure is very complex, so conventional locking devices have large outer dimensions. The assembling and installation of known locking devices is complicated.

It is an object of the present invention to provide a locking device for a door of a domestic appliance, wherein said locking device is fast switchable between an engaged and disengaged state, and wherein the locking device has a simply structure.

According to an embodiment a locking device for a door of a domestic appliance is provided, wherein

- the locking device comprises a main body,
- the locking device comprises a locking hook element supported pivoting in and/or at the main body,
- the locking hook element is pivoting between an engaged position and a disengaged position,
- the locking hook element is engageable with and disengageable from a corresponding counterpart,
- the locking device comprises an electric actuator arranged in and/or at the main body and mechanically connected or connectable to the locking hook element,
- the electric actuator effects the pivoting of the locking hook element from the engaged position to the disengaged position,

- the locking device comprises a first spring element interconnected between the locking hook element and the main body, and
- the first spring element effects a movement of the locking hook element from the disengaged position to the engaged position.

The main idea is the present invention is that the locking hook element is always in the engaged position, except the electric actuator effects the pivoting of the locking hook element from the engaged position to the disengaged position. If the door is in its closed position, then the locking hook element engages the counterpart and interlocks said door. The electric actuator effects an unlocking of the door. The first spring element effects automatically the locking of the door, if the door is in its closed position, except the electric actuator is activated.

In particular, the locking device is provided for a chassis or a front frame of the domestic appliance, while the corresponding counterpart is formed in and/or at the door. Alternatively, the locking device is provided for the door, while the corresponding counterpart is formed in and/or at the chassis or front frame of the domestic appliance.

Preferably, the counterpart is a recess for receiving a protruding part of the locking hook element. The recess may be realized by low complexity.

Further, an actuating slide element may be interconnected between the electric actuator and the locking hook element, wherein said actuating slide element effects the pivoting of the locking hook element from the engaged position to the disengaged position.

Moreover, the locking device may comprise a second spring element interconnected between the actuating slide element and the main body, wherein said second spring element effects a movement of said actuating slide element away from the locking hook element.

For example, an eccentric disc is interconnected between the electric actuator and the actuating slide element or locking hook element, wherein said eccentric disc is driven by the electric actuator.

In particular, the electric actuator is activated or activatable manually by a user. The electric actuator is activatable by the user for a short time, in which the door is unlocked and can be opened be the user.

Preferably, the locking hook element is made of metal.

Furthermore, the locking hook element may comprise an at least partially arched portion designed to cooperate with an inclined surface in the corresponding counterpart, so that the locking bar element is pushable at least partially into the disengaged position by means of the inclined surface of the corresponding counterpart during a closing operation of the door. The arched portion and the inclined surface allow a simple locking of the door.

Additionally, the locking device may comprise a door sensing slide element provided for detecting the presence or proximity of the door in a closed position or nearly closed position of said door.

In particular, the door sensing slide element is constrained to the main body by a third spring element.

Moreover, the locking device may comprise a sensor switch activated or activatable by the door sensing slide element, if said door sensing slide element is pushed by the door, wherein the sensor switch is electrically connected to a control system of the domestic appliance.

The locking device may comprise a cover element, wherein the main body and said cover element form a casing for the locking device, and wherein preferably the main body and/or the cover element are made of moulded thermoplastic material.

Further, the present invention relates to a domestic appliance including at least one door pivoted at one or more door hinges, wherein the domestic appliance comprises the locking device mentioned above.

Preferably, an opening force for the door is generated by the door hinge and/or by a separate spring element arranged between the door and the chassis or front frame of the domestic appliance.

Novel and inventive features of the present invention are set forth in the appended claims.

Figure 2:
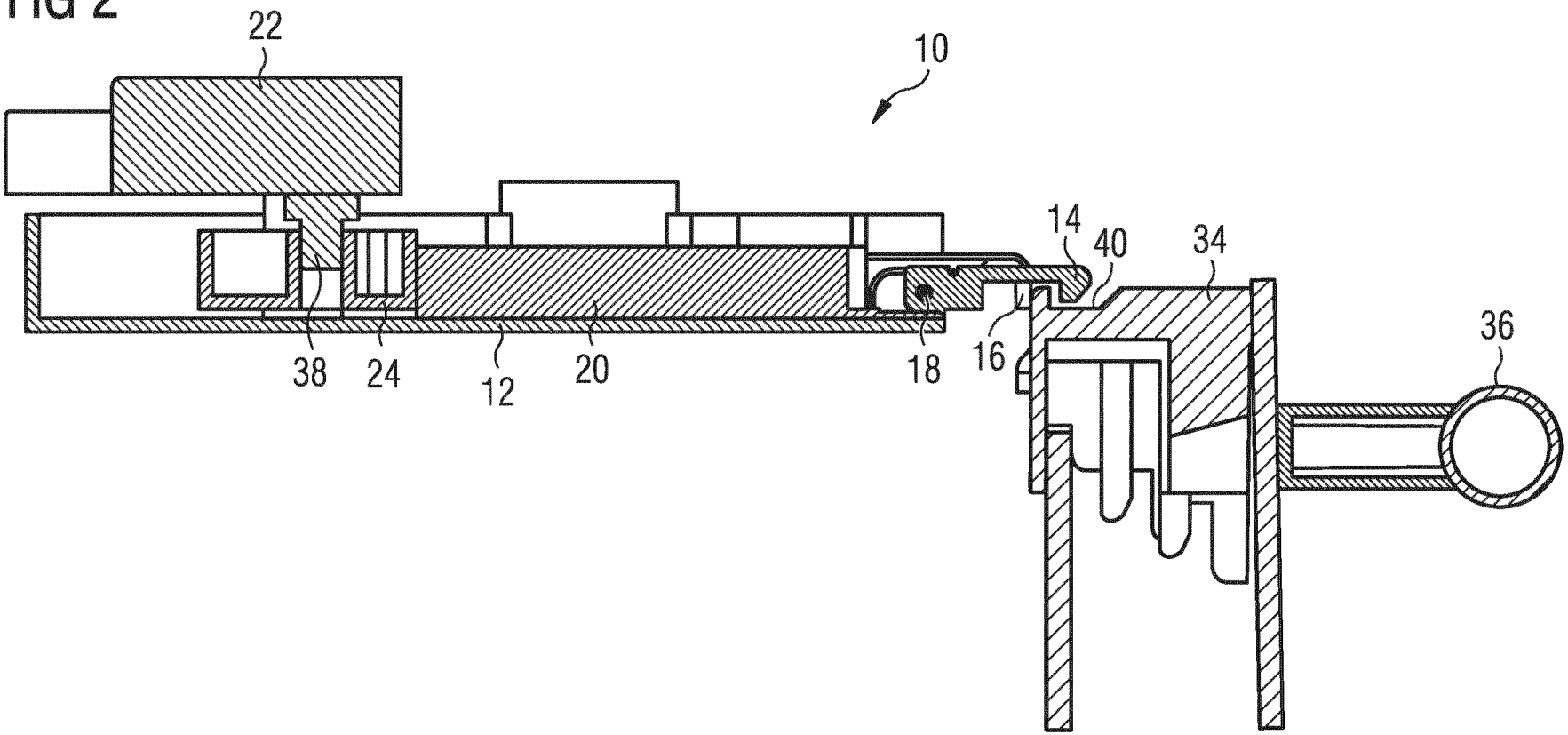
Figure 3:
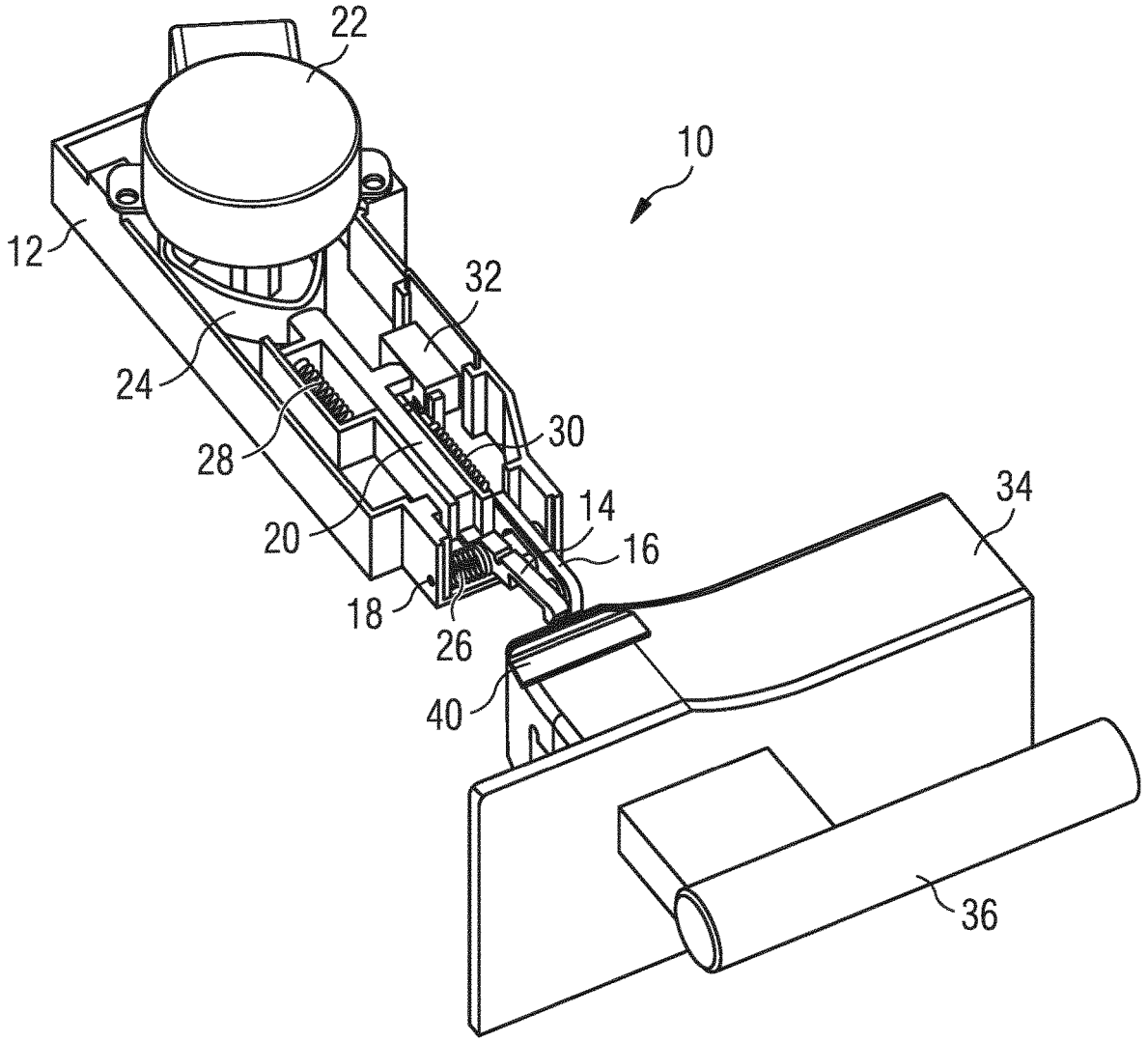
Figure 4:
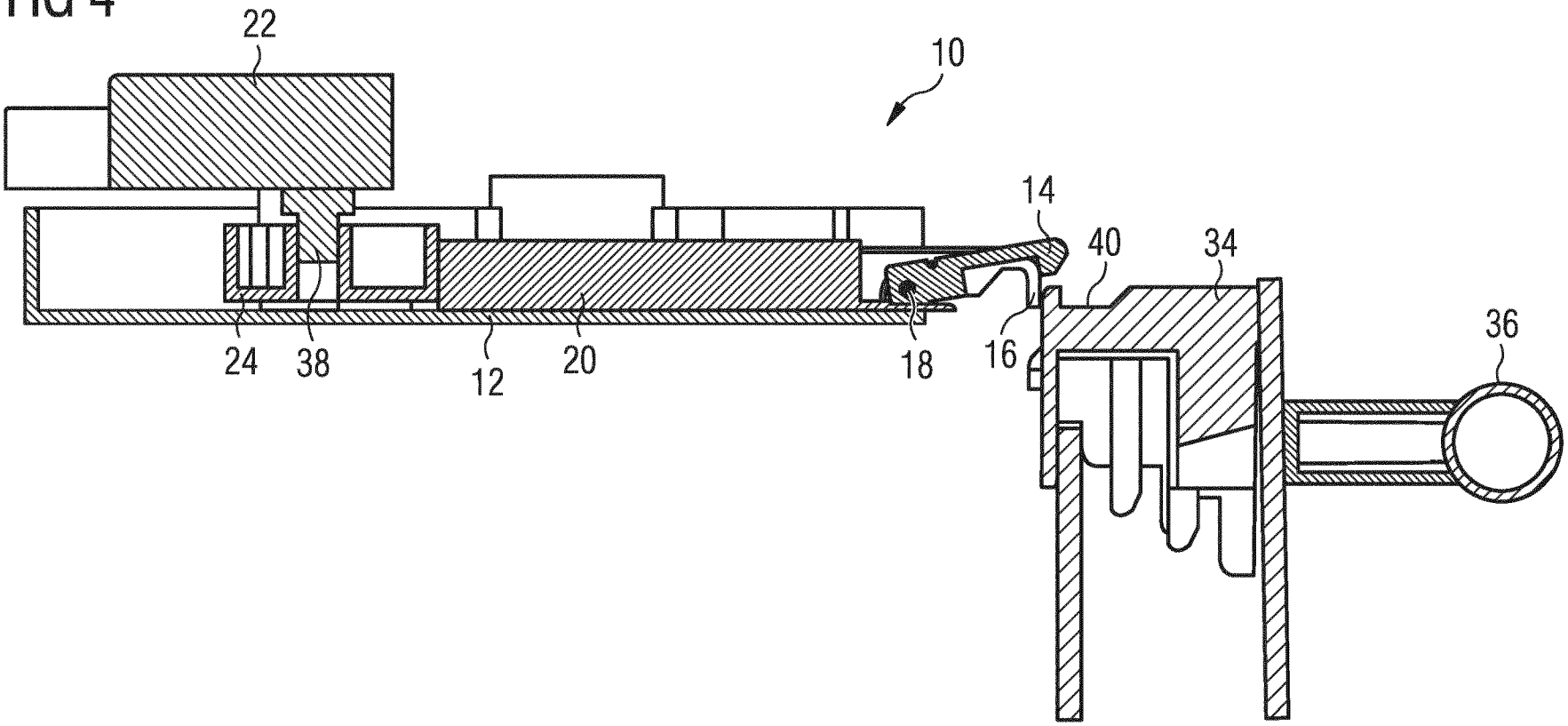
Figure 5:
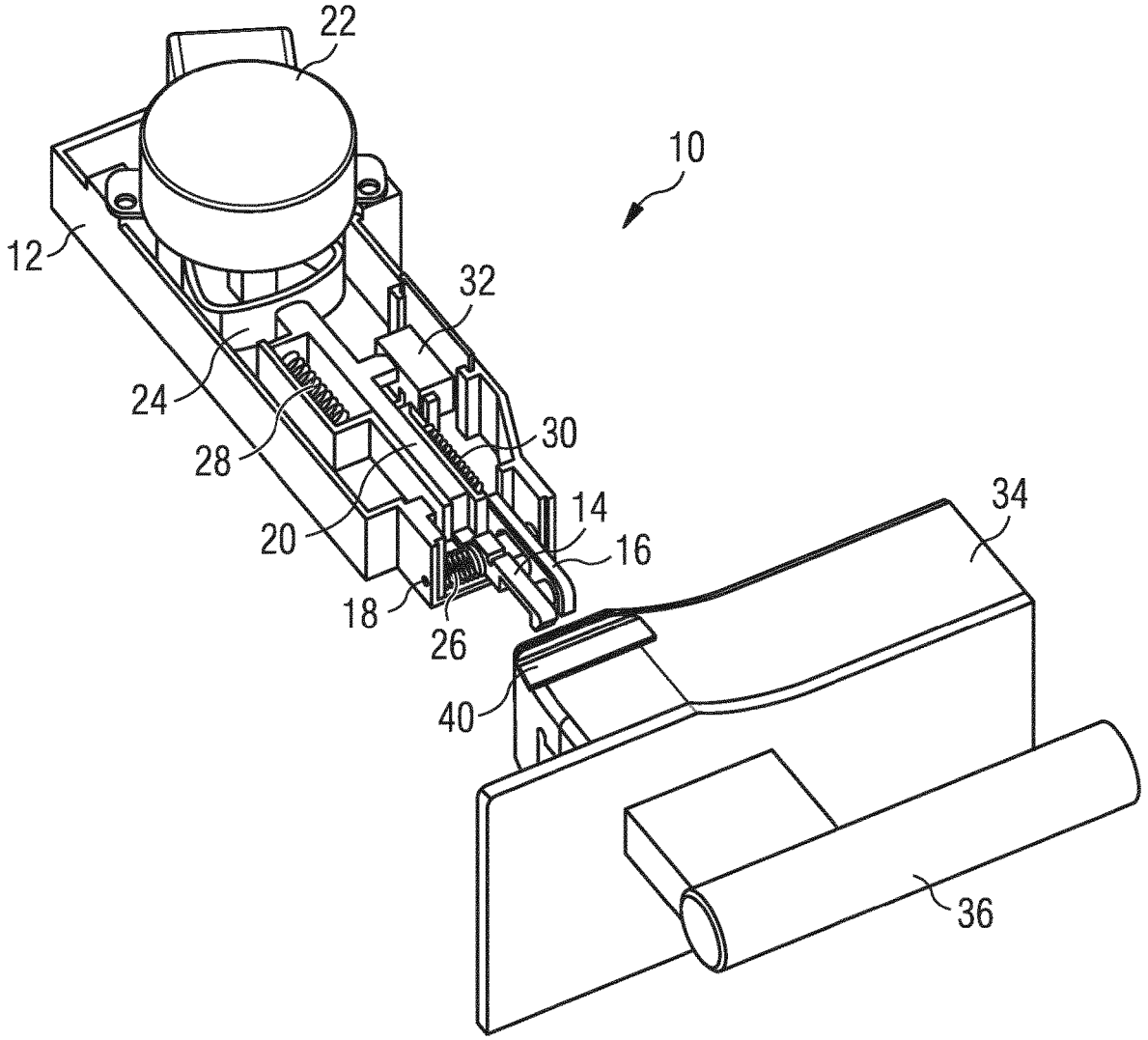
Figure 6:
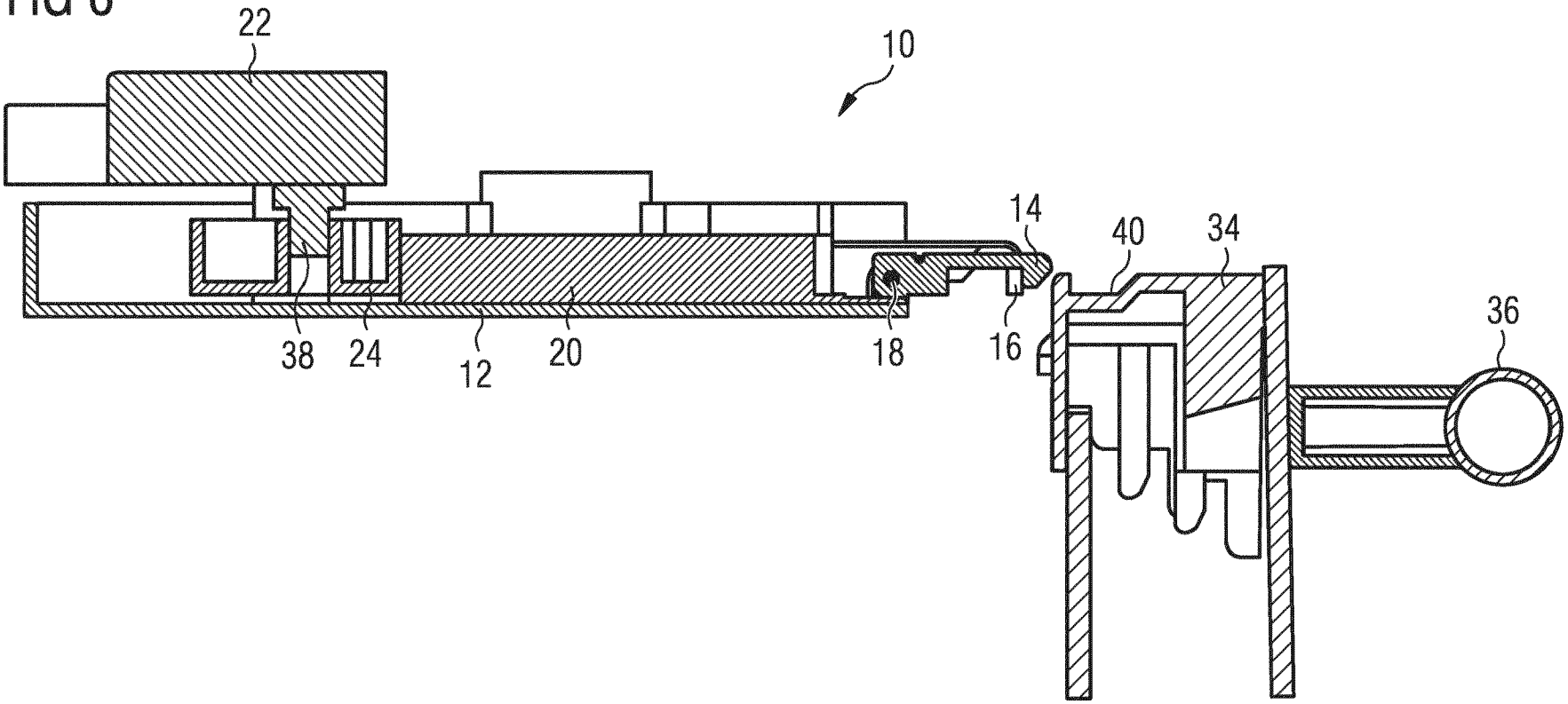

The present invention will be described in further details with reference to the accompanied drawings, in which FIG. 1 illustrates a schematic perspective view of a locking device for a door of a domestic appliance according to a preferred embodiment of the present invention in an engaged state, FIG. 2 illustrates a schematic sectional side view of the locking device according to the preferred embodiment of the present invention in the engaged state, FIG. 3 illustrates a schematic perspective view of the locking device for the door of the domestic appliance according to the preferred embodiment of the present invention in a disengaged state, FIG. 4 illustrates a schematic sectional side view of the locking device according to the preferred embodiment of the present invention in the disengaged state, FIG. 5 illustrates a schematic perspective view of the locking device for the door of the domestic appliance according to the preferred embodiment of the present invention in a partially opened state of the door, and FIG. 6 illustrates a schematic sectional side view of the locking device according to the preferred embodiment of the present invention in the partially opened state of the door.

FIG. 1 illustrates a schematic perspective view of a locking device 10 for a door 34 of a domestic appliance according to a preferred embodiment of the present invention in an engaged state. For example, the domestic appliance is a cooking oven and the door 34 is an oven door.

The locking device 10 comprises a main body 12, a locking hook element 14, a door sensing slide element 16, an actuating slide element 20, an electric actuator 22, an eccentric disc 24 and a sensor switch 32. Preferably, the main body 12 is closed by a cover element, which is not shown in FIG. 1, so that the main body 12 and the cover element form a casing of the locking device 10. For example, the main body 12 and the cover element are made of moulded thermoplastic material. The main body 12 is designed to be fastened to a cabinet or chassis of the domestic appliance.

The locking hook element 14 is supported pivoting at the main body 12 by a pin element 18 and projects partially out of said main body 10. The locking hook element 14 is pivoting between an engaged position and a disengaged position. In the engaged position, the locking hook element 14 is engageable with a recess 40 formed in or at the door 34 of the domestic appliance, if said door 34 is in the closed state. The engaged state is obtained, if the locking hook element 14 is in the engaged position and simultaneously the door 34 is in the closed state. Preferably, the locking hook element 14 is made of metal.

A first spring element 26 is interconnected between the main body 12 and the locking hook element 14. In this example, the first spring element 26 and is a torsion spring element and encloses the pin element 18. The first spring element 26 effects that the locking hook element 14 is pivoted into the engaged position.

The electric actuator 22 is arranged in or at the main body 12 of the locking device 10. The electric actuator 22 may comprise a rotating motor or solenoid motor. In this example, the electric actuator 22 comprises a rotating motor and is connected to the eccentric disc 24. The actuating slide element 20 is arranged between the eccentric disc 24 and the locking hook element 14. The actuating slide element 20 is linearly moveable between two positions. A rotation of the eccentric disc 24 driven by the electric actuator 22 pushes the actuating slide element 20 against the locking hook element 14, so that the locking hook element 14 is pivoted into the disengaged position. Thus, the unlocking of the door 34 occurs in an electro-mechanical way.

A second spring element 28 is interconnected between the main body 12 and the actuating slide element 20. In this example, the second spring element 26 and is a helical spring element. The second spring element 28 effects that the actuating slide element 20 is moved to the eccentric disc 24 and away from the locking hook element 14. Thus, the second spring element 26 allows that the locking hook element 14 can be pivoted into the engaged position by the first spring element 26.

The door sensing slide element 16 is arranged movable inside the main body 12 and projects partially out of said main body 12. In this example, the door sensing slide element 16 is arranged parallel to the actuating slide element 20. The door sensing slide element 16 is provided for detecting the presence or proximity of the door 34 in its closed position. If the door 34 is in the closed position or nearly in the closed position, then the door sensing slide element 16 is moved against the sensor switch 32 and actuates said sensor switch 32. The sensor switch 32 detects the opened and closed state of the door 34 independent of the operational mode of the locking device 10. The sensor switch 32 is connected to a controller 35 of a control system of the domestic appliance. If the door 34 is in the closed state, then the control system switches off the electric power for the electric actuator 22, so that the actuating slide element 20 is moved by the force of the second spring element 28 away from the locking hook element 14 and said locking hook element 14 is pivoted by the first spring 26 into the engaged position.

A third spring element 30 is interconnected between the main body 12 and the door sensing slide element 16. In this example, the third spring element 30 is a tension spring element. The third spring element 30 effects that the door sensing slide element 16 is moved away from the sensor switch 32, so that the sensing slide element 16 does not actuate the sensor switch 32.

FIG. 2 illustrates a schematic sectional side view of the locking device 10 according to the preferred embodiment of the present invention in the engaged state. The locking hook element 14 is engaged with the recess 40 of the door 34. The actuating slide element 20 is in a position away from the locking hook element 14 and does not actuate said locking hook element 14.

The actuating slide element 20 comes into contact with a part of the locking hook element 14, which part is arranged outside the pivoting axis of the locking hook element 14. Thus, the movement of the actuating slide element 20 against the locking hook element 14 generates a torsional moment of said locking hook element 14. If in FIG. 2 the actuating slide element 20 is moved from left to right, then the locking hook element 14 is pivoted counterclockwise around the pivoting axis. The pivoting axis corresponds with the longitudinal axis of the pin element 18.

The door sensing slide element 16 is pushed into the main body 12 by the door 34 and actuates the sensor switch 32. The sensor switch 32 detects that the door 34 is in the closed position.

Further, FIG. 2 shows that the electric actuator 22 and the eccentric disc 24 are connected via a shaft 38. The eccentric disc 24 is rotatable by the electric actuator 22.

In order to open the door 34 the locking hook element 14 has to be pivoted into the disengaged position. For example, the electric actuator 22 is manually activated by a user. Then, the electric actuator 22 rotates the eccentric disc 24, and said eccentric disc 24 pushes the actuating slide element 20 against the locking hook element 14. Then, the locking hook element 14 is pivoted against the force of the first spring 26, and the user can open the door 36 by pulling a door handle 36 attached at the outside of said door 34.

FIG. 3 illustrates a schematic perspective view of the locking device 10 for the door 34 of the domestic appliance according to the preferred embodiment of the present invention in a disengaged state.

In FIG. 3 the electric actuator 22 has rotated the eccentric disc 24, and said eccentric disc 24 has pushed the actuating slide element 20 against the locking hook element 14. Thus, the locking hook element 14 has been pivoted against the force of the first spring 26, so that the locking hook element 14 is disengaged from the recess 40 in the door 34. In this situation, the user is able to open the door 36 by pulling the door handle 36.

FIG. 4 illustrates a schematic sectional side view of the locking device 10 according to the preferred embodiment of the present invention in the disengaged state.

The eccentric disc 24 has been rotated by the electric actuator 22, so that the eccentric disc 24 has pushed the actuating slide element 20 against the locking hook element 14 and the locking hook element 14 has been pivoted against the force of the first spring 26. The locking hook element 14 is disengaged from the recess 40 in the door 34. Now, the user is able to open the door 36 by pulling the door handle 36.

FIG. 5 illustrates a schematic perspective view of the locking device 10 for the door 34 of the domestic appliance according to the preferred embodiment of the present invention in a partially opened state of the door 34.

In FIG. 5 the door 34 has been partially opened and the electric actuator 22 is deactivated. Thus, the eccentric disc 24 has been rotated back, so that the actuating slide element 20 has been moved away from the locking hook element 14 by the second spring element 28. The locking hook element 14 has been pivoted again into the engaged position by the force of the first spring 26. However, the locking hook element 14 is disengaged from the recess 40 in the door 34, since said door 34 is in the partially opened state. In this situation, the user is able to farther open the door 36 by pulling the door handle 36 or to closing the door 36 by pushing the door handle 36.

FIG. 6 illustrates a schematic sectional side view of the locking m device 10 according to the preferred embodiment of the present invention in the partially opened state of the door 34.

The eccentric disc 24 is in a status allowing that the actuating slide element 20 has been moved away from the locking hook element 14 by the second spring element 28. The locking hook element 14 has been pivoted again into the engaged position by the force of the first spring 26, but the locking hook element 14 is disengaged from the recess 40 in the door 34, since said door 34 is in the partially opened state. Now, the user is able to farther open the door 36 by pulling the door handle 36 or to closing the door 36 by pushing the door handle 36.

The locking device 10 of the present invention has a very simple structure, a low complexity and a less number of components. The electric actuator 22 and the first spring 26 allow very fast changes between the disengaged and engaged positions of the locking hook element 14. The locking hook element 14 and the recess 40 are engageable within a time of less than 0.2 seconds. In contrast, the conventional actuation systems require an activation time of about two seconds. The outer dimensions of the inventive locking device 10 are very small, so that the locking device 10 requires less installation space. Further, the weight of said locking device 10 is small. The locking device 10 according to the present invention can be easily and quickly assembled and installed.

In particular, the locking device 10 can have a safety function in an oven during a pyrolytic cleaning process. Further, the locking device 10 may be provided for preventing the door 34 being opened by children during normal cooking process of the oven.

Preferably, the locking device 10 is used in combination with a door hinge, wherein said door hinge does not generate any force for closing the door 34. Thus, the inventive locking device 10 allows the use of a door hinge formed by low complexity. Further, an opening force may be generated by the door hinge or a spring element arranged separately at the chassis or front frame of the domestic appliance.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 locking device
12 main body
14 locking bar element
16 door sensing slide element
18 pin element
20 actuating slide element
22 electric actuator
24 eccentric disc
26 first spring element
28 second spring element
30 third spring element
32 sensor element
34 door
36 door handle
38 shaft
40 recess

The invention claimed is:

1. A locking device for a door of a domestic appliance, wherein the locking device comprises a main body, the locking device comprises a locking hook element pivotably supported in and/or at the main body, the locking hook element is pivotable between an engaged position and a disengaged position, the locking hook element is engageable with and disengageable from a corresponding counterpart of the door, the locking device comprises an electric actuator arranged in and/or at the main body and mechanically connected or connectable to the locking hook element, the electric actuator effects the pivoting of the locking hook element from the engaged position to the disengaged position, the locking device comprises a first spring element interconnected between the locking hook element and the main body, and the first spring element effects a movement of the locking hook element from the disengaged position to the engaged position, wherein the locking device is configured to accept the counterpart of the door as said door is closed and to lock the door once it reaches a closed position even when the locking hook element is already in the engaged position as the door is closed, wherein an actuating slide element is operatively coupled between the electric actuator and the locking hook element, wherein said actuating slide element effects the pivoting of the locking hook element from the engaged position to the disengaged position.

2. The locking device according to claim 1, wherein the locking device is provided for a chassis or a front frame of the domestic appliance, while the corresponding counterpart is formed in and/or at the door.

3. The locking device according to claim 1, wherein the counterpart is a recess for receiving a protruding part of the locking hook element.

4. The locking device according to claim 1, wherein the locking device comprises a second spring element interconnected between the actuating slide element and the main body, wherein said second spring element effects a movement of said actuating slide element away from the locking hook element.

5. The locking device according to claim 1, wherein an eccentric disc is engaged to and between the electric actuator and the actuating slide element or locking hook element, wherein the eccentric disc is driven by the electric actuator.

6. The locking device according to claim 1, wherein the electric actuator is activated or activatable manually by a user.

7. The locking device according to claim 1, wherein one of the locking hook element and the corresponding counterpart comprises an at least partially arched portion designed to cooperate with an inclined surface at the other of the locking hook element and the corresponding counterpart, so that the locking hook element is pushable at least partially into the disengaged position by means of the corresponding counterpart during a closing operation of the door.

8. The locking device according to claim 1, wherein the locking device comprises a door sensing slide element provided for detecting the presence or proximity of the door in a closed position or nearly closed position of said door, which door sensing slide element is configured to effect switching of a sensor switch of the locking device to thereby cause indication of presence or proximity of the door.

9. The locking device according to claim 8, wherein the door sensing slide element is constrained to the main body by an additional spring element.

10. The locking device according to claim 8, wherein the locking device comprises the sensor switch which is activated or activatable by the door sensing slide element if said door sensing slide element is pushed by the door, wherein the sensor switch is electrically connectable to a control system of the domestic appliance.

11. A domestic appliance including at least one door pivotable at one or more door hinges, wherein the domestic appliance comprises at least one locking device according to claim 1.

12. The domestic appliance according to claim 11, wherein an opening force for the door is generated by the door hinge and/or by a separate spring element arranged between the door and the chassis or front frame of the domestic appliance.

13. A locking device for a door of a domestic appliance, comprising:

a hook pivotable at a main body about an axis between an engaged position where said hook is configured to interact with and thereby lock the door in a closed position thereof, and a disengaged position where the hook does not interact with the door thus allowing the door to be opened, said hook being biased into said engaged position by a biasing element interconnected between the hook and the main body, said hook comprising an engagement portion that is offset from said axis;

an actuating slide translatable toward and away from said engagement portion of said hook and being biased away from said engagement portion, wherein said hook pivots into said disengaged position when said actuating slide engages and presses against said engagement portion, and pivots back into said engaged position when said actuating slide disengages and translates away from said engagement portion;

an electric actuator having an activated state wherein the actuator rotates an eccentric disc from a lock position to an unlock position thereby causing said actuating slide to translate toward and against said engagement portion, and a deactivated state wherein the actuator returns said eccentric disc to said lock position thereby permitting the actuating slide to translate according to its bias thus disengaging and translating away from said engagement portion;

a door sensor configured to detect when said door is in said closed position; and a controller coupled to said electric actuator, said controller configured to deactivate said actuator when said door is in said closed position such that said hook defaults to said engaged position thereby locking the door when said door is in its closed position;

wherein to open said door first a user must manually activate said actuator to thereby cause said hook to rotate against its bias into said disengaged position thus permitting said door to be opened, and wherein the locking device is configured to accept the counterpart of the door as said door is closed and to lock the door on reaching its closed position even when the hook is already in the engaged position as the door is closed.

14. The locking device according to claim 13, said controller being configured such that after a user manually activates said actuator to permit opening said door, the controller automatically will deactivate said actuator thus returning said hook to its default, engaged position once said door sensor detects that the door has been opened.

15. The locking device according to claim 13, said hook being effective to pivot from said disengaged position to said engaged position within 0.2 seconds upon deactivation of said actuator.

16. The locking device of claim 13, said sensor comprising a door sensing slide and a sensor switch, said door sensing slide being movable against, to thereby actuate, said sensor switch when said door engages the door sensing slide as the door approaches or arrives in said closed position thereof, wherein upon actuation of said sensor said controller deactivates said actuator.

17. An appliance comprising the locking device according to claim 13 for locking a door of the appliance, said door being pivotable to and from said closed position via a door hinge, wherein the door hinge does not generate any force for closing the door.

18. The locking device according to claim 1, wherein the locking device further is configured to accept the counterpart of the door and to lock the door on reaching its closed position both while the locking hook element is already in the engaged position as the door is closed and absent actuation of the electric actuator.

19. The locking device according to claim 13, wherein the locking device further is configured to accept the counterpart of the door and to lock the door on reaching its closed position both while the hook is in already the engaged position as the door is closed and absent actuation of the electric actuator.

* * * * *